US005590771A

United States Patent [19]

Cota

[11] Patent Number: 5,590,771

[45] Date of Patent: Jan. 7, 1997

[54] CONSOLIDATED MUSIC INSTRUMENT CASE WITH AMPLIFIER AND SPEAKERS

[76] Inventor: Jose G. Cota, 2928 E. LaMarche, Phoenix, Ariz. 85032

[21] Appl. No.: 363,603

[22] Filed: Dec. 23, 1994

[51] Int. Cl.[6] ..... A45C 11/00

[52] U.S. Cl. ..... 206/314; 190/102; 190/114; 381/24

[58] Field of Search ..... 206/14, 314, 579; 190/102, 114, 100; 312/7.1; 181/145, 199; 381/24, 188

[56] References Cited

U.S. PATENT DOCUMENTS

| | | | |
|---|---|---|---|
| 732,983 | 7/1903 | Whitney | 190/114 |
| 2,226,900 | 12/1940 | Dickerson | 206/314 |
| 3,642,102 | 2/1972 | Furniss et al. | 190/114 |
| 3,943,564 | 3/1976 | Tushinsky | 381/24 |
| 4,070,546 | 1/1978 | Hirota | 381/24 |
| 4,151,909 | 5/1979 | Markov | 206/314 |
| 4,223,785 | 9/1980 | Jacques | 206/314 |
| 4,474,290 | 10/1984 | DeMato | 206/45.23 |
| 4,696,037 | 9/1987 | Fierens | 381/24 |

*Primary Examiner*—David T. Fidei
*Attorney, Agent, or Firm*—Richard R. Mybeck; Peter B. Scull

[57] ABSTRACT

A musical instrument case containing one or more amplifiers and a plurality of speakers is described. The consolidated case comprises a substantially rectangular base portion having a recess configured to receive and retain a musical instrument therewithin. Pivotally attached to the base portion are first and second triangular cover members that are coactively adapted to fold over and completely cover or enclose the base portion leaving no exposed gaps.

15 Claims, 2 Drawing Sheets

CONSOLIDATED MUSIC INSTRUMENT CASE WITH AMPLIFIER AND SPEAKERS

INTRODUCTION

The present invention relates generally to portable music systems and more particularly to a unique musical instrument case comprising a self-contained amplifier and speaker assembly in which a pair of hinged triangular speakers is adapted to selectively stabilize the system during use and to fold over and enclose the base for storage or transport.

BACKGROUND OF THE INVENTION

Many modern musicians are mobile performers. They often travel to a variety of venues to give a plurality of performances within short time periods. Thus, these entertainers need easily transportable, compact sound equipment which is readily convertible between storage and set-up. Furthermore, especially solo and small group entertainers need as few different carrying cases as possible to cut down on the bulk to be moved from location to location.

Of course, there have been several efforts in the prior art to address one or more of these needs. For example, Kirk, U.S. Pat. No. 1,352,814, teaches a trunk for a harp or like instruments which includes supporting and holding devices affixed to the interior of the trunk to secure therein a collapsible chair and a platform which the musician removes and uses during a performance.

Another, Weir in U.S. Pat. No. 2,231,235 teaches a case that houses built-in amplifying and speaker units, along with an electrical stringed instrument to be played therewith. The Weir case has a rectangular body and two hinged rectangular cover sections. The larger of the cover sections is hinged to one of the longitudinal sides of the body, and the smaller cover section is hinged to one of the transverse body sides. A narrow weather strip is attached to the larger cover and covers the necessary margin between the two cover sections when they are folded over the body to close the case. The margin is necessary to ensure surface to surface covering of the cover sections over the body.

A design patent granted to Peterson et al. (U.S. Des. Pat. No. 269,480) shows another carrying/storage case which includes a built-in electronic device for controlling electrical instrument components. Peterson's rectangular case has two latched openings hinged on its opposite ends, one of which forms a control display stand for the built-in electrical control device. When standing upright, the top end of this case flips over to expose the integrally built-in control board for use during instrument play.

While it appears that upright standing musical instrument cases are known which are adapted to contain and/or stow more than mere instruments and which may include electronic control devices and amplifier/speaker units built therein, none of the prior art cases involve a structural coaction between uniquely configured triangular cover members in the manner by which they fold over and complement each other to completely cover the entire base portion without interfering with each other in closing the case. Further, no prior case does this while also providing an upright, stabilized open case for use as an integral on-stage amplifier/speaker system. It is toward these goals that the present invention is directed.

BRIEF SUMMARY OF THE INVENTION

The present invention relates generally to portable music systems and more particularly to a unique musical instrument case containing all the necessary elements for an electric instrument system. Specifically, the case comprises three basic structural parts, a substantially rectangular base and two triangular speaker cabinets which also function as cover members that uniquely fold over and enclose or cover the base.

The base has a plurality of compartments including: a padded instrument storage area, a plurality of accessory compartments, preferably at least three amplifier compartments (one for the instrument and two for other music sources), a compartment for storage of the instrument amplifier when not in use, and one or more music compartments for a compact disc (CD) player, a cassette player recorder, an AM/FM radio, or the like.

The triangular speaker cabinets each preferably contain three speakers, one each corresponding to the instrument amplifier and the others for left and right stereo bass and treble for the CD, cassette, or other alternative standard music sources. Structurally, unique frame supports are built into these speaker cabinets to strengthen the respective face plates thereof which each bear a set of three speakers. The frame supports comprise one or more lateral supports attached to a face plate and one or more dowels inserted through holes formed in said lateral supports.

One of the speaker cabinets is permanently hinged to one side of the base to, when closing the case, fold over and enclose a triangular one half of the base. The other cabinet is detachably hinged to the opposing side of the base. When opened for playing the musical instrument through the speakers, the detachable cabinet is detached, inverted and re-attached to the base to form, in coaction with the base and the opened first speaker cabinet, an on-stage amplifier/speaker system in a symmetrical frusto-triangular shape. To close the case, the detachable cabinet is again removed, inverted and re-hinged so that when folded over the base, it encloses the remaining triangular one-half of the base. In this way, the two cabinets coact to form a uniformly rectangular cover for the base. This means of closure allows for complete surface to surface engagement of the speaker cabinets relative to each other over the base so that no structural gaps are left exposed. Thus, the complete system is consolidated in one secure case for ready storage or transport.

Electrically, this case and all the components therein are capable of being powered either completely by battery power or by standard external sources. Total portability is assured by the use of battery power in that a musician can use this system to perform anywhere, anytime.

Accordingly, the principal object of the present invention is to provide a portable self-contained musical instrument system in a case having a substantially rectangular base and two triangular speaker assemblies which coact to completely enclose the base and leave no exposed gaps for storage or transport.

Another object of the present invention is to provide unique structural frame supports for the two triangular speaker assemblies.

These and still further objects as shall hereinafter appear are readily fulfilled by the present invention in a remarkably unexpected manner as will be readily discerned from the following detailed description of an exemplary embodiment thereof especially when read in conjunction with the accompanying drawings in which like parts bear like numerals throughout the several views.

DESCRIPTION OF THE PREFERRED EMBODIMENT

Figures 1, 2, 3, 4, 5:
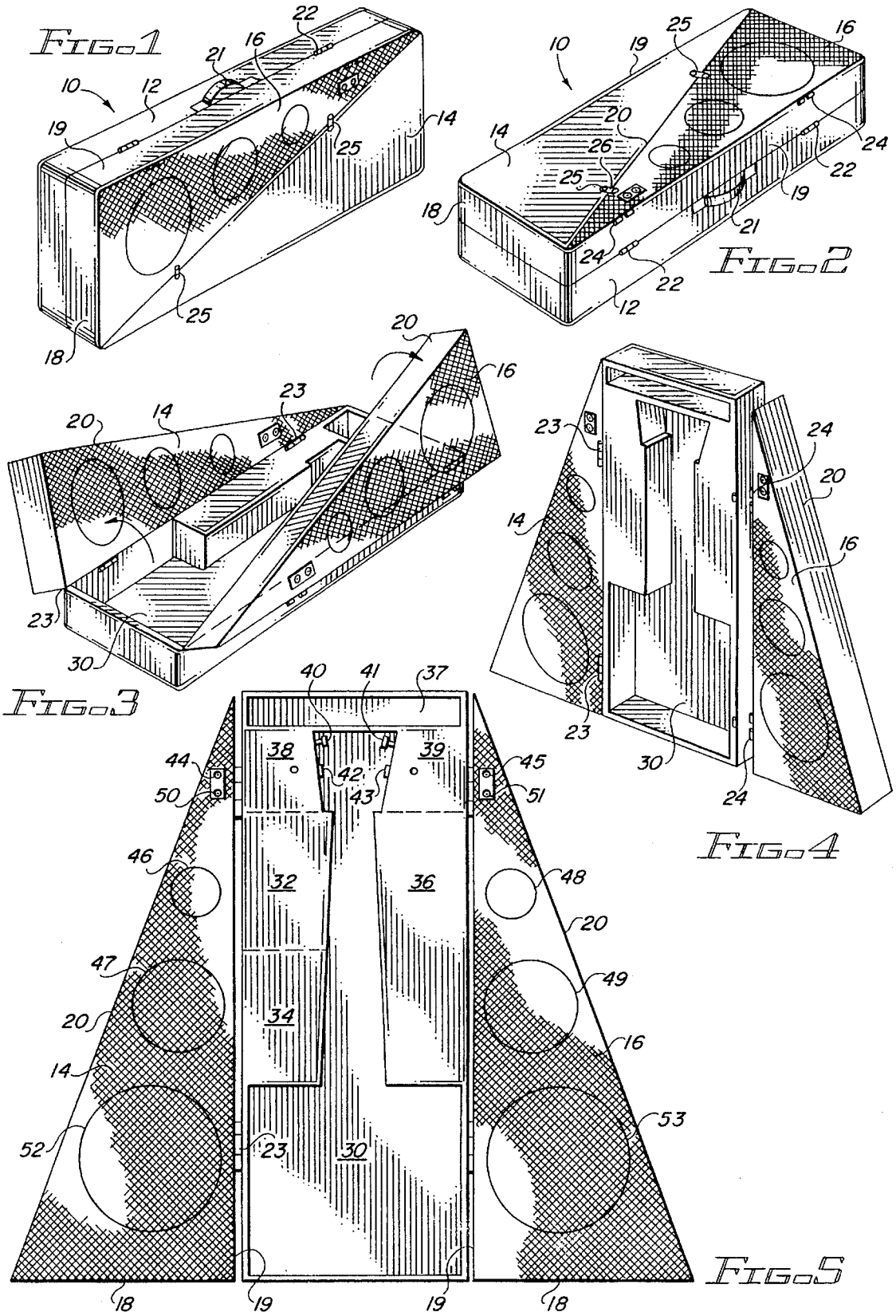
FIG. 1 is a perspective view of the music instrument case of the present invention in closed position ready for storage or transport.
FIG. 2 is another perspective view of the music instrument case of FIG. 1 in closed position ready to be opened for play.
FIG. 3 is a perspective view of the music instrument case of FIGS. 1 and 2 shown during the process of opening (or closing) the case.
FIG. 4 is yet another perspective view of the music instrument case of FIGS. 1–3 shown in upright position with one cover member detached and inverted ready to be reattached for play.
FIG. 5 is a front elevational view of the instrument case of FIGS. 1–4 shown in open, ready to play position.

The present invention relates generally to musical instrument cases and more particularly to the musical instrument case shown in the attached drawings and identified by the general reference numeral 10.

As shown in FIGS. 1 and 2, case 10 has a base portion 12 and first and second triangular cover members 14 and 16, respectively. First and second cover members 14 and 16 are sufficiently thick to contain a plurality of speaker elements as will be described in more detail below. Thus, cover members 14 and 16 also function as speaker cabinets.

Base portion 12 is a substantially rectangular hexahedron and cover members 14 and 16 are pentahedrons having two opposing, congruent, preferably right triangular faces. Each triangular face has a base, height and hypotenuse side. The remaining three faces of each cover member 14 and 16 are three rectangular faces or side panels corresponding to the base, height and hypotenuse sides of the triangular faces. The three rectangular faces of each cover member 14, 16 are designated here as base faces 18, height faces 19 and hypotenuse faces 20. As shown in FIGS. 1 and 2, the hypotenuse faces 20 of each cover member 14 and 16 meet each other in surface to surface relationship when case 10 is disposed in closed position.

FIGS. 1 and 2 also show a handle 21 and hinges 22 which provide for pivotal attachment of cover member 16 to base portion 12. Similar hinges 23 (shown only in FIGS. 3–5) are provided to likewise pivotally attach cover member 14 to base portion 12. Also shown fastened to cover member 16 are hinge portions 24 which are unconnected to base portion 12 in FIGS. 1–4 and are used to hingedly re-attach cover member 16 to base portion 12 for play as shown in FIGS. 4 and 5. The re-attachment process will be described further below.

Cover members 14 and 16 are held fast in closed position by one or more simple fastening means such as the two pairs of button fasteners 25 shown in FIGS. 1 and 2. Each of the preferred button fasteners 25 includes a string 26 which is wrapped multiple times around each of the button spindles attached to the respective cover members 14 and 16. Though button fasteners 25 are used in the preferred embodiment, any of a number of fastening means may be used to keep cover members 14 and 16 fastened to base portion 12.

Referring now to FIGS. 4 and 5, a music case 10 is shown in an upright, virtually ready to play position. Base portion 12 is, as shown, the substantially rectangular, central part of case 10. Base 12 preferably has a specially configured recess 30 for receiving a particular preselected musical instrument such as a guitar (not shown) and further has a plurality of compartments, such as compartments 32, 34 and 36, for receiving various musical accessories. Compartments 32, 34 and 36 may be of any desired shape to contain any of a number of desirable accessories such as separate alternative music sources which may include for example, compact disc (CD) players, cassette tape player/recorders, and/or radio receivers (none of which are shown). In the preferred embodiment, compartments 32 and 34 are specifically adapted to contain a portable CD player (not shown) and a cassette tape player/recorder (also not shown). Compartment 36 is preferably adapted to receive a musical instrument amplifier unit (not shown) for storage and transportation. Slot 37 is specially made to hold said musical instrument amplifier unit during musical instrument play in order to make all of its controls easily accessible to the musician.

FIG. 5 also shows two compartments 38 and 39 into each of which, in the preferred embodiment, an alternative source music amplifier has been built. Each of these amplifiers is detachably connected, via wiring internally located in base portion 12, to compartments 32 and 34. Thus, these amplifiers can be connected one each to the CD player and the cassette player/recorder preferably located in compartments 32 and 34, respectively. Each amplifier has one or more controls such as volume control knobs 40 and 41 as shown in FIG. 5.

The amplifiers in compartments 38 and 39 also have standard output jacks 42 and 43, respectively. Two separate, standard music connectors or cables (not shown) are plugged, one end of each, into jacks 42 and 43. The other end of one such cable is connected to input jack 44 in cover member 14 while the other cable is connected to jack 45 in cover member 16. Further internal wiring (not shown) in cover member 14 connects input jack 44 to both treble speaker 46 and bass speaker 47, while a similar arrangement (also not shown) in cover member 16 likewise connects input jack 45 to treble speaker 48 and bass speaker 49.

A separate, yet similar system is used to electrically connect the musical instrument amplifier (not shown), which as mentioned above is to be operably disposed in slot 37, to speaker input jacks 50, 51 by standard connection cables as described above, and then by internal wiring to instrument speakers 52 and 53 in cover members 14 and 16, respectively. By also connecting an electrical musical instrument to said amplifier in a conventional manner, the instrument can be played so that amplified sounds can be produced and made to emanate from speakers 52 and 53.

Figure 6:
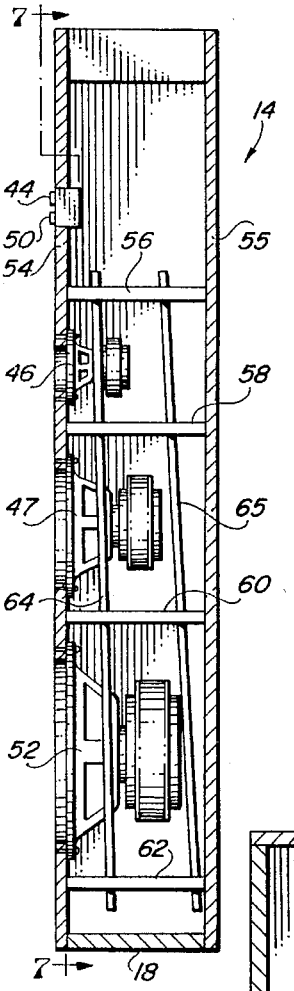
FIG. 6 is a cross-sectional view of a side elevation of one cover member of the present invention.
Figure 8:
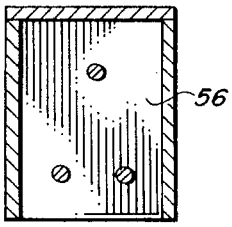
FIG. 8 is a cross-sectional view of a support member in the cover member of FIG. 7 taken on line 8—8 thereof.
Figure 9:
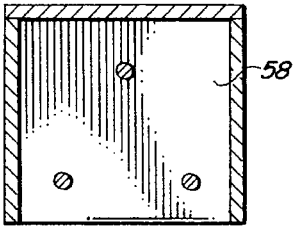
FIG. 9 is a cross-sectional view of a support member in the cover member of FIG. 7 taken on line 9—9 thereof.
Figure 10:
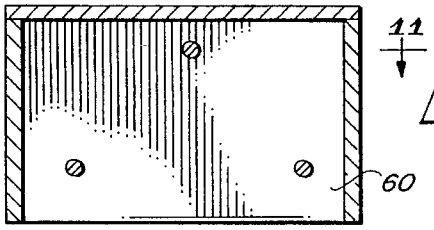
FIG. 10 is a cross-sectional view of a support member in the cover member of FIG. 7 taken on line 10—10 thereof.
Figure 11:
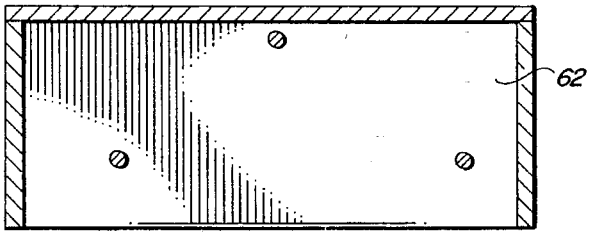
FIG. 11 is a cross-sectional view of a support member in the cover member of FIG. 7 taken on line 11—11 thereof.
Figure 7:
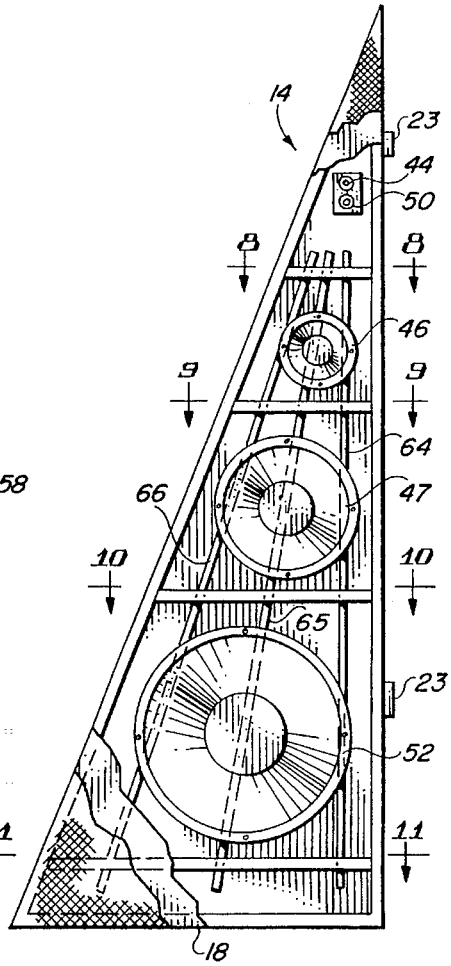
FIG. 7 is a front elevational view of the cover member of FIG. 6 as taken on line 7—7 thereof.

The interiors of the preferred embodiments of cover members 14 and 16 have unique framing structures built therein. For example, FIGS. 6 and 7 show such a framing structure as built into cover member 14. This framing structure is representative of the framing structure in cover member 16 and/or in any other similarly built device intended to be covered herein.

The critical components of the framing structure are one or more dowels inserted through one or more framing members. In particular, face plate 54 has fastened thereto several lateral frame members shown and designated herein as members 56, 58, 60 and 62. It is recognized that these frame members are not necessarily, but may also be attached to rear plate 55 of cover member 14. However, this rear plate connection is not required because the principal advantage gained is the strengthening of face plate 54 which, depending on the material used, is naturally unsturdy or weak due to the attachment of speakers 46, 47 and 52 thereto.

As can be seen in FIGS. 6 and 7, lateral frame members 56–62 are attached one each above and/or below an adjacent speaker 46, 47 or 52. Note, as shown in FIG. 7 and by comparing FIGS. 8–11 which are each drawn to the same scale, these lateral frame members are preferably progressively wider and thus present a wider displacement between corresponding holes therein as one proceeds downward from lateral frame member 56 to member 58 and so on to lateral frame member 62. Dowels 64, 65 and 66 are then inserted in and through the corresponding holes cut through lateral frame members 56–62. Note also that it is preferable to install dowels 64–66 such that they are angled slightly away from the perpendicular relative to each of the lateral frame members 56–62. This, then, allows for dowels 64–66 to be held in place by frictional forces such that no other fastening means need to be used to secure dowels 64–66 therein.

Case 10 is preferably made from conventional materials such as wood, lightweight metals or sturdy plastics. The exposed portions of base 12 and cover members 14 and 16 may optionally be covered with a protective material such as a sturdy plastic or leather-type material. Externally, base portion 12 is preferably generally rectangular while the interior of base portion 12 is shaped, as described above, to have a recess 30 which receives a musical instrument such as a guitar or other stringed instrument. Again, multiple materials could be used to create the proper interior shape as is well understood in the industry. Wooden frames and plywood or molded plastic interiors could be so used. Either way, the preferred embodiment uses a felt, crushed velvet or other suitable padding material covering the entire interior of base 12, especially recess 30, to provide an appropriately cushioned receiving and storage area for a musical instrument.

As mentioned above, triangular cover members 14 and 16 are preferably made right-triangularly shaped such that they each have a base face 18, a height face 19 and a hypotenuse face 20. Further, cover members 14 and 16 are constructed from conventional materials such as those described for base member 12 above and are preferably made as are conventional musical speakers so that they produce high quality sound. Cover members 14 and 16 may also be covered with external protective material and may additionally have conventional speaker screens attached to the front faces thereof to cover the speakers in the common manner known to those in the art.

During construction of the preferred embodiment of case 10, certain desirable components, including particular portions of electrical wiring, are built into and hidden within the three basic structural members; base portion 12, and cover members 14 and 16. As mentioned above, the wiring from the alternative music source amplifiers contained in compartments 38 and 39 is built into base 12 such that each of the two sets of such wiring is connected to the respective interiors of each of the alternative music source storage compartments 32 and 34. Further, the power cables (not shown) for the amplifiers (and optionally also for the alternative music sources in compartments 32 and 34) are built into and are thereby hidden in base portion 12. Preferably, these power cables run to and emerge in compartment 36. All of the electrical devices usable herewith including instruments or other music sources are desirably powered by either battery power (which batteries would be stored in compartment 36) or by standard 120 volt (120 V) electrical outlet power. A standard 120 V power cord that is connectable to an external power outlet is provided and stored in compartment 36. Switching between battery and 120 V electrical sources is accomplished by flipping a toggle switch also located in compartment 36.

FIGS. 1 and 5 show case 10 in two different operable positions. In FIG. 1, case 10 is operable for carrying or storage while FIG. 5 shows case 10 in open, fully assembled position ready for the production of music. The process of converting from either operable position to the other is shown in FIGS. 2–4.

Thus, in order to, for example, convert from the closed carrying position of FIG. 1 to the open playing position of FIG. 5, one would first position case 10 as shown in FIG. 2 and then disengage fasteners 25. Then, cover members 14 and 16 are pivoted as shown in FIG. 3 about their respective hinges 23 and 22 up and away from recess 30 in base portion 12 to expose the interior of case 10. The directions of movement of cover members 14 and 16 to open case 10 are indicated by the arrows in FIG. 3.

Once fully pivoted open, cover member 16 must be detached, inverted and reattached to base portion 12 to put case 10 in the open, ready to play, frusto-triangular position shown in FIGS. 4 and 5. To do so, the pins in hinges 22 are first removed and then cover member 16 is physically removed and then inverted so that base face 18 of cover member 16 is positioned substantially in line with base face 18 of the permanently attached cover member 14. Note, cover member 16 is not only inverted it must also be turned in an about-face so that the faces of speakers 48, 49, and 53 are directed to project sounds in substantially the same direction as those of cover member 14 as shown in FIG. 4. Then, in completing the opening process and going from FIG. 4 to FIG. 5, the pins once removed from hinges 22 are inserted to connect hinge portions 24 with the corresponding hinge portions on base 12 so that cover member 16 is properly hingedly attached to base portion 12. Case 10 may then be put in upright playing position such that base faces 18 of cover members 14 and 16 are placed directly on the ground or on some other desirable support surface.

To finalize the preparation of case 10 as shown in FIG. 5 for music production, the electronic devices must all be properly connected using conventional cables (not shown) suitably stored in the case 10 as in slot 37. Primarily, this entails connecting the musical instrument (which is first removed from recess 30) to the musical instrument amplifier which, in turn is to be connected to the speakers. In detail, the conventional musical instrument amplifier (not shown) is taken out of storage compartment 36 and placed in operable position within slot 37. The standard control knobs and input and output jacks of such a musical instrument amplifier are left exposed so that a musical instrument (not shown) can be connected to a conventional input therein in a conventional manner. Instrument speakers 52 and 53 are similarly connected via jacks 50 and 51 to standard output jacks in the instrument amplifier. As mentioned above, the conventional instrument amplifier preferred to be used herewith may be either battery powered or connected to a standard 120 V electrical power outlet. Thus, when properly connected as described including being connected to a proper power supply, case 10 is ready to produce musical sounds in coaction with a musician playing the musical instrument connected thereto.

The optional, alternative music sources may also be used in conjunction with the musical instrument such that a musician can play along with and practice or learn the music provided by the alternative source, or the source can be used to provide background or supporting beats, rhythms, or voices to accompany the musician during performances. The alternative sources, also as mentioned above, are preferably electrically connected via internal wiring inside compartments 32 and 34 to the amplifiers in compartments 38 and 39. Standard connection cables are then connected, one from output jack 42 to input jack 44 which is located in cover member 14 and another from output jack 43 to input jack 45 in cover member 16. Internal wiring within cover members 14 and 16 connects jacks 44 and 45 to treble and bass speakers 46, 47 and 48, 49, respectively. Again, the alternative music sources are preferably either battery powered or accept 120 V line power. Internal wiring within base portion 12 provides preferable power connections in which the several amplifiers and optional music sources may be combined to receive power from a single battery pack or external outlet source.

To return device 10 to the storage/carrying position shown in FIG. 1, a process opposite to the opening procedure described above is followed. First, all of the electrical connections are disengaged, and the cables are stored in any of the compartments having sufficient room, which in the preferred embodiment means they are stored in slot 37 after the instrument amplifier is removed therefrom and stored in compartment 38. Note, in the preferred embodiment, the instrument amplifier has greater depth than both base portion 12 and consequently slot 37, and thus must be removed and stored sideways in compartment 38.

Next, the pins holding hinge portions 24 of cover member 16 to the corresponding hinge portions on base portion 12 are removed, cover member 16 is about-faced, inverted and reattached to base portion 12 at hinges 22. The musical instrument is placed in recess 30 and cover members 14 and 16 are pivoted in the reverse directions from those shown in FIG. 3 into closed position. Finally, the fastening means represented herein by button fasteners 25 are engaged and case 10 is again made ready for transport or storage.

From the foregoing, it is readily apparent that a new and useful embodiment of the present invention has been herein described and illustrated which fulfills all of the aforestated objects in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A musical instrument case comprising: a substantially rectangular base portion having a recess configured to receive and retain a musical instrument therewithin; and first and second triangular cover members that are pivotally attached to said base portion, said first and second cover members having one or more speakers disposed therein, said first and second triangular cover members being adapted to completely cover said base portion, said first and second triangular cover members also being of certain thickness as defined by three rectangular side faces, one of said rectangular side faces on said first triangular cover member being adapted to complementally meet one of said rectangular side faces on said second triangular cover member in substantially surface to surface engagement so that no structural gaps are left exposed.

2. A musical instrument case according to claim 1 in which said first and second triangular cover members are right triangularly shaped such that each cover member has a base side, a height side and a hypotenuse side.

3. A musical instrument case according to claim 2 in which said first and second triangular cover members are positioned relative to said base portion such that in covering said base portion, said hypotenuse side of said first triangular cover member meets in abutting edge to edge engagement with said hypotenuse side of said second triangular cover member.

4. A musical instrument case according to claim 1 in which said second triangular cover member is detachably attached to said base portion such that said second triangular member is invertible for the alternate creation of a rectangular shape in coaction with said first triangular cover member when covering said base portion, and the creation of a frusto-triangular shape in coaction with said base portion and said first triangular cover member when said second triangular cover member is inverted and said first and second triangular cover members are put in open position relative to said base portion.

5. A musical instrument case according to claim 1 in which said base portion further has one or more electronic amplifiers built therein.

6. A musical instrument case according to claim 1 in which at least one of said one or more speakers is dedicated to producing musical instrument sounds.

7. A musical instrument case comprising: a substantially rectangular base portion having a recess configured to receive a musical instrument therewithin, said base portion further having one or more storage compartments for receiving and retaining a plurality of music accessories; and first and second triangular cover members, said first triangular cover member being pivotally attached to one side of said base portion, said second triangular cover member being detachably and pivotally attached to the opposing side of said base portion, said first and second triangular cover members being coactively adapted to fold over and completely enclose said recess and said compartments in said base portion.

8. A musical instrument case according to claim 7 in which said first and second triangular cover members are right triangularly shaped such that each cover member has a base side, a height side and a hypotenuse side.

9. A musical instrument case according to claim 8 in which said first and second triangular cover members are positioned relative to said base portion such that in covering said base portion, said hypotenuse side of said first triangular cover member meets in abutting edge to edge engagement with said hypotenuse side of said second triangular cover member.

10. A musical instrument case according to claim 7 in which said second triangular cover member is detachably attached to said base portion such that said second triangular member is invertible for the alternate creation of a rectangular shape in coaction with said first triangular cover member when covering said base portion, and the creation of a frusto-triangular shape in coaction with said base portion and said first triangular cover member when said second triangular cover member is inverted and said first and second triangular cover members are put in open position relative to said base portion.

11. A musical instrument case according to claim 7 in which said first and second triangular cover members each contain one or more speakers.

12. A musical instrument case according to claim 7 in which said music accessories comprise one or more electronic amplifiers for said musical instrument.

13. A musical instrument case according to claim 7 in which said music accessories comprise alternative sound sources.

14. A musical instrument case according to claim 1 in which said first and second triangular cover members are speaker cabinets each having: a front face plate, a rear plate and a plurality of side panels attached to said rear plate; one or more speakers attached to said front face plate which is detachably attached to said plurality of side panels; said front face plate having attached thereto one or more lateral frame members which each have one or more holes cut therethrough; and one or more dowels which are inserted in and through said holes in said lateral frame members to provide greater strengthening support to said front face plate.

15. A musical instrument case according to claim 11 in which said first and second triangular cover members are speaker cabinets each having: a front face plate, a rear plate and a plurality of side panels attached to said rear plate; one or more speakers attached to said front face plate which is detachably attached to said plurality of side panels; said front face plate having attached thereto one or more lateral frame members which each have one or more holes cut therethrough; and one or more dowels which are inserted in and through said holes in said lateral frame members to provide greater strengthening support to said front face plate.

* * * * *